United States Patent [19]

Reese

[11] 4,078,420

[45] Mar. 14, 1978

[54] DIGITAL WATCH ANALYZER

[75] Inventor: Robert O. Reese, Lancaster, Pa.

[73] Assignee: Time Computer, Inc., Lancaster, Pa.

[21] Appl. No.: 776,274

[22] Filed: Mar. 10, 1977

Related U.S. Application Data

[63] Continuation of Ser. No. 662,244, Feb. 27, 1976, abandoned.

[51] Int. Cl.[2] ..... G04B 17/00

[52] U.S. Cl. ..... 73/6

[58] Field of Search ..... 73/6

[56] References Cited

U.S. PATENT DOCUMENTS

| | | | |
|---|---|---|---|
| 3,238,764 | 3/1966 | Greiner | 73/6 |
| 3,654,449 | 4/1972 | Boyee | 235/156 |
| 3,816,730 | 6/1974 | Yamamoto | 235/156 |
| 3,892,124 | 7/1975 | Reese | 73/6 |
| 3,946,591 | 3/1976 | Yanagawa | 73/6 |
| 3,946,592 | 3/1976 | Ichikawa | 73/6 |

*Primary Examiner*—S. Clement Swisher
*Attorney, Agent, or Firm*—LeBlanc & Shur

[57] ABSTRACT

Disclosed is an analyzer for producing a digital display of the rate of deviation of a solid state wristwatch from a predetermined norm. It comprises a counter and calculator into which are gated a series of high frequency pulses for a period of time dependent upon the operating frequency of the wristwatch time base under test. Included is a keyboard connected by a manual switch to the calculator so that the device may be operated in a calculator mode as well as a clock circuit by means of which the digital display may be used to indicate time.

17 Claims, 3 Drawing Figures

DIGITAL WATCH ANALYZER

This is a continuation of application Ser. No. 662,244 filed Feb. 27, 1976 now abandoned.

This invention relates to a wristwatch analyzer or a tester and more particularly is directed to an electronic instrument of this type which provides a digital display. It is adapted for use by jewelers, watchmakers and the like in order to determine exactly how fast or how slow a solid state quartz wristwatch is operating so that proper tolerance can be restored if necessary. Incorporated in the device is a time and calendar display and mounted on the front panel is a keyboard for operation as a calculator. Finally a front panel fixture enables the operator of the instrument to test a watch battery.

Instruments for testing the operating accuracy of a conventional wristwatch have been known for many years. However, a conventional mechanical wristwatch operates at a relatively low frequency, commonly in the neighborhood of from 2½ to 3 Hz. Devices for testing conventional wristwatches at this relatively low frequency have been found unsuitable for testing the accuracy of the newer so-called quartz watches in which the timekeeping standard is a quartz crystal oscillator operating at frequencies of several tens of khz and higher. Furthermore, there has been need of a suitable device for testing quartz crystal watches sufficiently simple and inexpensive so that it could be afforded by and used by a jeweler or watchmaker to time a wristwatch having a relatively high frequency time base.

In order to overcome these and other problems, there is disclosed in assignee's U.S. Pat. No. 3,892,124, issued July 1, 1975, an instrument which while affordable by a watchmaker or jeweler and simple enough for use with a minimum of electronic expertise nevertheless exhibits the precision and reliability necessary to detect very small deviations of time in even the most precise of the generally highly accurate quartz time pieces. While useful in testing and analyzing almost all types of quartz watches, the analyzer of that patent is particularly adapted to analyze a light emitting diode quartz crystal watch of the type shown and described in assignee's U.S. Pat. No. 3,759,031, 3,803,827, and others, sold under the trademark PULSAR. These wristwatches as shipped from the factory are guaranteed to have an accuracy within plus or minus five seconds per month with the time base operating at a frequency of 32,768 Hz. This relatively high frequency and extreme accuracy imposed severe demands on any analyzer in terms of an inexpensive unit that can be bought by a small jeweler or watchmaker and one which is sufficiently simple and reliable in operation that it can be used by operators relatively unskilled in the use of electronic equipment.

The present invention is directed to a wristwatch analyzer of the same general type as that in U.S. Pat. No. 3,892,124, but one which has increased sensitivity for sensing the lower energy levels of the smaller timepieces and one which presents a digital display for ease of reading. In the present invention the operating light emitting diode wristwatch is placed face down on the test instrument or analyzer. Electromagnetic energy at the frequency of the watch time base passes through the viewing window of the watch where it impinges upon a disc-shaped antenna or a pick-up probe imbedded in the instrument support. The frequency of the time base is detected and displayed so that the frequency of the watch, if necessary, may be adjusted to come within the desired tolerance. Variations from the desired frequency of as little ±0.1 second per month can be detected and indicated.

Additional features of the present invention include the fact that the analyzer incorporates both time (including calendar) and calculator features. By placing the analyzer in the time mode the eight display digits of the analyzer display time and calendar information continuously. In the calculate mode the user has at his disposal a four function, eight digit floating point calculator with memory interfacing with a small front mounted keyboard. This combination not only provides better energy sensing qualities for the analyzer, but fully exploits the built-in large scale integrated circuit calculator and watch circuits or chips of the device.

It is therefore one object of the present invention to provide an improved digital wristwatch analyzer.

Another object of the present invention is to provide a wristwatch analyzer which combines with the analyzer a calculator circuit.

Another object of the present invention is to provide a wristwatch analyzer which combines with the analyzer a timekeeping circuit.

Another object of the present invention is to provide a wristwatch analyzer which includes timekeeping and calendar features as well as a battery tester.

Another object of the present invention is to provide an improved analyzer circuit with increased sensitivity.

Another object of the present invention is to provide a digital wristwatch analyzer in which the same display is used for out-of-frequency indications, time and calendar indications, and calendar computations.

These and further objects and advantages of the invention will be more apparent upon reference to the following specification, claims and appended drawings wherein:

Figure 1:
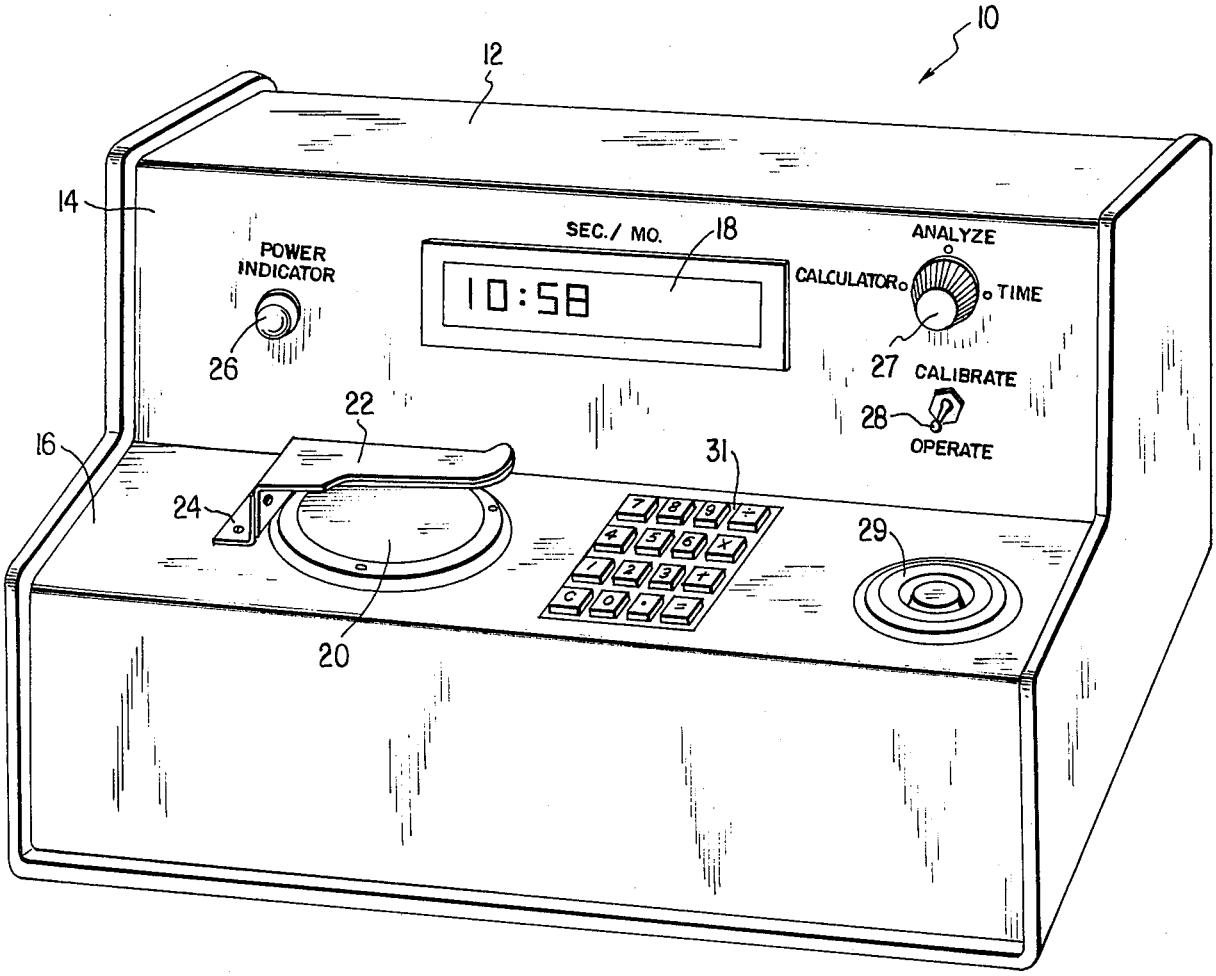
FIG. 1 is a perspective view of a wristwatch analyzer constructed in accordance with the present invention.

Referring to the drawings, the analyzer of the present invention generally indicated at 10 in FIG. 1 comprises a stepped housing 12 having a substantially vertical front panel 14 and a substantially horizontal deck 16. The vertical front panel 14 is provided with a viewing window containing a digital display 18 and on the horizontal section 16 is a support 20 for testing a light-emitting diode wristwatch. By way of example only, the wristwatch may be of the type shown and described in assignee's U.S. Pat. Nos. 3,759,031 and 3,803,827. Within the case of such a watch is a timing standard in the form of a crystal controlled oscillator operating at a normal frequency of 32,768 Hz. The oscillator output passes through a frequency divider and a display actuator circuit to illuminate a plurality of light-emitting diodes when a demand button on the side of the wristwatch case is depressed. The illuminated diodes which give a visual indication of time are viewed through a transparent window in the front of the watch case. Reference may be made to assignee's U.S. Pat. Nos. 3,759,031 and 3,803,827, for a more detailed description of one type of wristwatch which may be tested on the analyzer 10 of FIG. 1.

As viewed in FIG. 1, the watch is placed face down on the support 20 so that the transparent window of the wristwatch is in close proximity to an antenna at the top of the support. This antenna is preferably in the form of a flat circular conductive metal disc covered by epoxy or other suitable electrical insulating material which insulation spaces the antenna from the watch case. Electromagnetic energy at the frequency of the quartz crystal oscillator within the watch case is radiated through the viewing window to impinge on the antenna. By removing a back plate on the watch case access may be had to a trimmer or tuning capacitor which can be adjusted to vary the timing frequency of the time standard or crystal oscillator of the wristwatch.

Overlying support 20 is an L-shaped conductive metal clamp 22 which is secured to the panel 16 by an angle bracket 24. The clamp supports the watch bracelet and also acts as a radiation shield for the antenna support 20 to minimize the effects of stray electromagnetic radiation on the antenna. A "power-on" indicator light 26 is on the vertical panel 14 along with a calibrate switch 28 and mode adjustment switch 27. Carried by the horizontal panel 16 is a watch battery cell tester 29 and a calculator keyboard 31.

Figure 2:
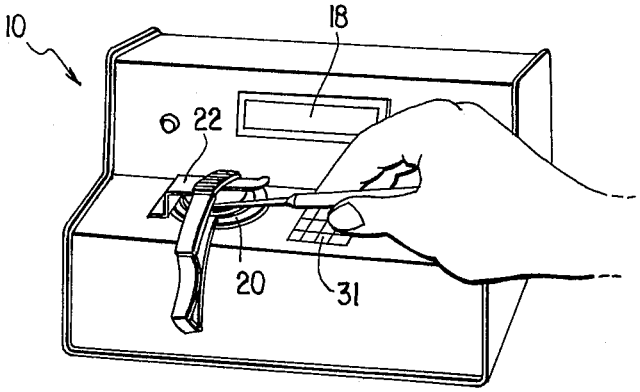
FIG. 2 is a perspective view of the analyzer of FIG. 1 showing a watch having its timing adjusted.

FIG. 2 shows the analyzer with a wristwatch resting on the support 20 and the watch bracelet looped over clamp 22. The watch is shown in FIG. 2 being adjusted for timing rate as it rests on the support. In order to obtain this adjustment, the regular wristwatch back plate is removed and a temporary plate having an aperture substituted for it so that an adjusting tool such as a screwdriver may be inserted through the aperture in the temporary back plate to adjust the tuning capacitor.

Figure 3:
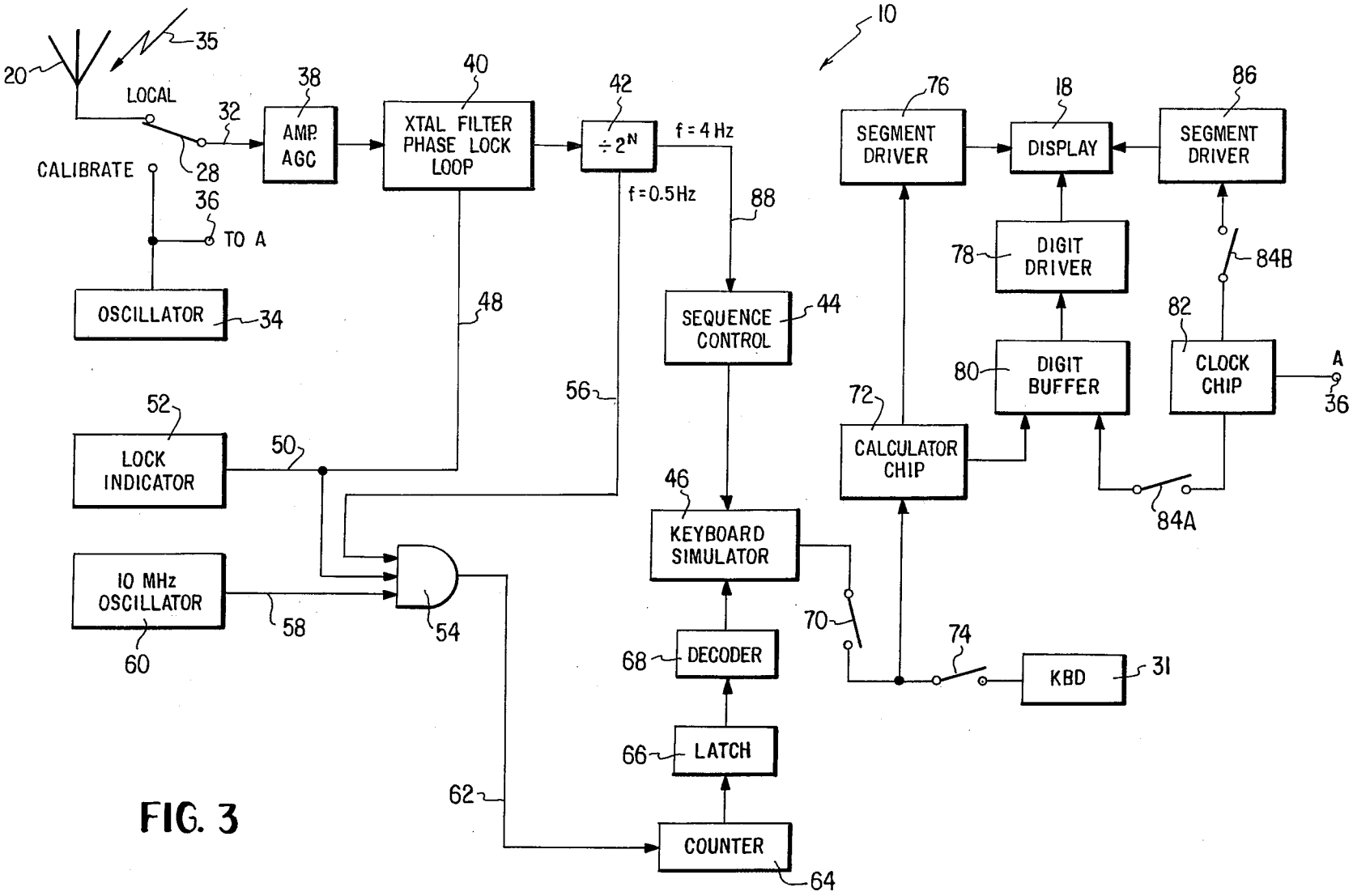
FIG. 3 is a detailed block diagram showing the circuitry of the analyzer of FIGS. 1 and 2.

FIG. 3 is a detailed block diagram of the electrical circuitry for the analyzer 10 of FIGS. 1 and 2 in which like parts bear like reference numerals. It shows the calibrate switch 28 in the operate position as connected to antenna 20. In the other position the input of the device represented by a lead 32 is connected to a precision oscillator 34 operating at 32,768 Hz. The output of this oscillator is also connected to a clock terminal 36 as more fully described below. With the antenna receiving electromagnetic energy as indicated by the arrow 35 the energy passes through the switch to an amplifier and AGC (automatic gain control) circuit 38 to a crystal controlled phase locked loop filter 40. The signal then passes through a divider 42 and a sequence controller 44 to a keyboard simulator 46. The feedback loop of filter 40 is connected by leads 48 and 50 to lock indicator 52 and to an AND gate 54. Other inputs to gate 54 are by way of a lead 56 from divider 42 and by way of a lead 58 from a 10 megahertz oscillator 60.

The output of gate 54 feeds by way of a lead 62 a binary counter 64 in turn coupled by way of a latch 66 and decoder 68 to the keyboard simulator 46.

The keyboard simulator 46 is connected through a switch 70 to a calculator circuit 72 preferably in the form of a large scale integrated single chip circuit. Keyboard 31 is similarly connected to calculator chip 72 by a switch 74. Display 18, which by way of example only may be an eight digit LED (light-emitting diode) display of the seven segment type, is actuated from the calculator chip 72 by way of a segment driver 76 and by way of a digit driver 78, the latter through a digit buffer 80. A clock chip 82 receives a time base signal from precision oscillator 34 by way of terminal 36. When switches 84A and 84B are closed, the clock chip is connected to display 18 through a segment driver 86 and through the digit buffer 80 and digit driver 78. While the circuit, if desired, may be formed of NMOS, PMOS, or CMOS integrated circuits, it is particularly adapted in the preferred embodiment to be constructed using $I^2L$ chips (integrated injection logic).

In operation, the wristwatch is placed on the antenna and the energy from the watch is picked up by the amplifier in automatic gain control circuit 38. The amplifier signal is connected to a ±2 Hertz crystal filter and phase lock loop circuit 40. If the time base or the quartz frequency of the wristwatch is within the pass band of filter 40, the loop locks and the filter passes the signal to the divider 42. From the divider 42 a 0.5 Hertz signal is passed by way of lead 56 to one input of the three input AND gate 54.

Also connected to the AND gate is a 10 megahertz signal from oscillator 60 and the line 48 from the phase lock loop filter 40. When the phase lock loop filter 40 locks in, a signal appears on lead 48 and the 10 megahertz signal from oscillator 60 is gated into the binary counting chain 64 for a time period of one second, namely a half cycle of the output of divider 42 appearing on lead 56. The data or count in counter 64 represents one half the period of the 0.5 Hertz signal plus or minus small error variations in the wristwatch being tested. The binary coded decimal (bcd) output lines of counter 64 are connected to the latch circuit 66. This latch circuit holds the raw time period data until the data is strobed into the bcd to decimal decoder 68. Keyboard simulator 36 is a series of transmission gates accepting inputs from the decoder and from the sequence control 44 and applying an output through switch 70 to the calculator chip 72. When in the calculate rather than analyze mode, mode switch 70 is open and switch 74 is then closed to connect the calculator chip 72 to the keyboard 31 instead of to the keyboard simulator 46 as previously described. A third position for the knob 27 is illustrated in FIG. 1 where both switches 70 and 74 are opened and switches 84A and 84B are closed to present the time mode and connect the clock chip 82 to the display.

When in the analyze mode switches 74, 84A and 84B are open and switch 70 is closed. A 4 Hz. signal from divider 42 is applied by way of a lead 88 to sequence controller 44. If the loop of filter 40 is locked, this initiates the sequence controller 44. The result is that in precise order the timing pulses from the sequence controller 44 enable the keyboard simulator 46 causing the measured period data from decoder 68 to pass to the registers of calculator chip 72. Signals produced by the keyboard simulator cause that data in the calculator to be normalized and multiplied by the constant 2.628. The result of this operation is to produce the out-of-tolerance error of the wristwatch being tested as computed in seconds per month. The computed data in calculator 72 is multiplexed to the LED display 18 by the segment driver 76 and the digit buffer and driver 78 and 80. The data is displayed for approximately one second or until the counter 74 and latch 66 are refreshed. Once this occurs the entire operation is repeated.

When the device is in the time mode, time and calendar information is displayed continuously. In the preferred embodiment the display is in the form of eight seven segment display stations so that hours and minutes are displayed on the right most four stations. If desired, the left most six stations may be used for hours, minutes and seconds with only the day of the month displayed in numerical form on the right most two stations. When in the calculate mode, the device operates as a conventional calculator with the calculator chip controlled from the keyboard 31 and the display used in the conventional manner of an LED calculator display. When in the analyze mode, the data in counter 64 is continuously displayed to eight digits (four to the left of the decimal point and four to the right) and this digital display which is continuous is refreshed or updated each second. The numerical reading on the analyzer mode is representative of the time deviation or rate of error of the wristwatch under test in seconds per month.

It is apparent from the above that the present invention provides an improved analyzer circuit having an increased sensitivity making it capable of sensing lower energy levels for the smaller timepieces constantly being introduced, such as those utilizing only a single one and one half volt battery cell, and is particularly directed to the provision of a multi-function analyzer, that is one which is also a timepiece, calculator and a battery tester. The battery tester 29 is in all respects the same as that disclosed in assignee's U.S. Pat. No. 3,892,124 and reference may be had to that patent for a detailed discussion of its construction and operation, the disclosure of that patent being incorporated herein by reference.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed and desired to be secured by United States Letters Patent is:

1. A timing rate tester for wristwatches having an electrical time standard, comprising: an electro-optical digital display; a calculator circuit coupled to said display; a wristwatch support including an antenna for sensing electrical energy from the time standard of an operating wristwatch mounted on said support; a high frequency oscillator for producing a series of high frequency pulses; a divider coupled to said antenna for producing a series of low frequency pulses; a gate circuit coupled to said divider and said high frequency oscillator whereby the pulses from said oscillator are gated by the output of said divider; a counter coupled to the output of said gate; sequence control means coupled to the output of said divider; keyboard simulator means coupled to the outputs of said sequence control means and said counter for transmitting data from said counter to said calculator circuit under the control of said sequence control means and for controlling said calculator circuit to operate on the data transmitted from said counter in a pre-determined manner; a keyboard; and a manually operated mode switch coupled to said calculator circuit for alternatively coupling said keyboard simulator and said keyboard to said display.

2. A timing rate tester according to claim 1 including a timing circuit, said mode switch including means for coupling said timing circuit to said display.

3. A timing rate tester according to claim 1 wherein said electro-optical display comprises a plurality of light-emitting diodes.

4. A timing rate tester according to claim 3 wherein said diodes form eight display stations.

5. A timing rate tester according to claim 5 wherein said diodes comprise a seven bar segment array; a plurality of segment drivers coupling said calculator circuit to one side of said diodes and a plurality of digit drivers coupling said calculator circuit to the other side of said diodes.

6. A timing rate tester according to claim 5 including a binary coded decimal to decimal decoder coupling said counter to said calculator circuit.

7. A timing rate tester according to claim 6 said keyboard simulator coupling said decoder to said calculator circuit.

8. A timing rate tester according to claim 1 including a filter coupling said antenna to said divider.

9. A timing rate tester according to claim 8 wherein said filter comprises a phase locked loop.

10. A timing rate tester according to claim 9 wherein the phase locked loop of said filter is coupled to said gate whereby pulses from said high frequency oscillator pass through said gate only when said loop is locked in.

11. A timing rate tester according to claim 9 wherein said divider supplies an output to said gate having a frequency of approximately ½ hertz.

12. A timing rate tester according to claim 9, said keyboard simulator acting to multiply the output of said counter by a factor of 2.628.

13. A timing rate tester according to claim 9 comprising a calibrate oscillator and switch means for alternatively coupling the input of said filter to said antenna and said calibrate oscillator.

14. A timing rate tester according to claim 13 including a clock circuit coupled to the output of said calibrate oscillator and manual switch means for coupling the output of said clock circuit to said display.

15. A timing rate tester according to claim 14 comprising a horizontal front panel upon said which watch support is mounted, said panel also carrying said keyboard.

16. A timing rate tester according to claim 15 including a watch battery cell tester on said front horizontal panel.

17. A timing rate tester according to claim 16 comprising a vertical front panel containing said display and upon which said mode switch is mounted.

* * * * *